US005611083A

United States Patent [19]

Arnold

[11] Patent Number: 5,611,083

[45] Date of Patent: Mar. 18, 1997

[54] CHANGING ROBE

[76] Inventor: Barbara A. Arnold, Modesto, CA

[21] Appl. No.: 519,462

[22] Filed: Aug. 25, 1995

[51] Int. Cl.[6] ..... A41D 3/08

[52] U.S. Cl. ..... 2/84; 2/69

[58] Field of Search ..... 2/84, 88, 69, 69.5, 2/247, 252, 94, 83, 95, DIG. 2, 114

[56] References Cited

U.S. PATENT DOCUMENTS

| | | | |
|---|---|---|---|
| 1,337,698 | 4/1920 | Gongora | 2/DIG. 2 X |
| 1,467,718 | 9/1923 | Entrikin et al. | 2/88 |
| 1,569,960 | 1/1926 | Geisler . | |
| 3,079,611 | 3/1963 | Boryszewski | 2/69 X |
| 3,288,157 | 11/1966 | Szkolny | 2/69 X |
| 3,381,306 | 5/1968 | Innes | 2/69 |
| 3,837,006 | 9/1974 | Laseman | 2/69.5 X |
| 4,602,390 | 7/1986 | Morera et al. | 2/247 X |
| 4,864,657 | 9/1989 | Lake | 2/114 |
| 5,005,217 | 4/1991 | Bern et al. . | |
| 5,034,999 | 7/1991 | Lubbers . | |
| 5,042,090 | 8/1991 | Cook . | |
| 5,101,513 | 4/1992 | Bowers | 2/69 X |
| 5,208,918 | 5/1993 | Royal . | |
| 5,259,068 | 11/1993 | Carroll . | |

*Primary Examiner*—C. D. Crowder
*Assistant Examiner*—Gloria Hale
*Attorney, Agent, or Firm*—Thomas M. Freiburger

[57] ABSTRACT

A robe-like garment for use in changing clothes is large and loose-fitting on the wearer, with a hood, a large neck opening and a pair of short enlarged-diameter sleeves. In the front of the changing robe is a large central pocket which is accessible by zipper from the outside front of the garment and is also accessible from the inside of the garment. The changing robe is sufficiently roomy to permit the user to disrobe and change clothes inside the robe, retrieving clothing to be worn from the interior access of the large pocket, and placing the changed clothing in the same pocket. The sleeves of the robe are short enough and have large enough openings to permit convenient withdrawal of the user's arms to the interior of the robe. In a preferred embodiment the garment is formed of a liquid-absorbent terry cloth. The changing robe is useful in situations such a public beaches, for changing into and out of swimming gear. A slightly modified form is provided for wheelchair-bound persons, enabling the robe to be slipped down over the head and torso without leaving the sitting position.

10 Claims, 2 Drawing Sheets

CHANGING ROBE

BACKGROUND OF THE INVENTION

This invention relates to garments, and in particular the invention is concerned with a robe which can be worn in public to facilitate the changing of clothing underneath the robe.

U.S. Pat. No. 3,079,611 shows a type of garment made from two opposing terry cloth towels which are releasably secured together, with a pocket formed on the inside of one of the towels. The device is disclosed as useful in permitting changing into and out of beach attire.

U.S. Pat. Nos. 5,034,999 and 5,259,068 disclose garments for use by nursing mothers, for covering the baby and the breasts during nursing, while also enabling the mother to view the baby through pockets or openings.

U.S. Pat. No. 1,569,960 discloses a disposable paper raincoat for fitting loosely over a user, with an opening for the head and neck.

U.S. Pat. Nos. 4,864,657, 5,005,217, 5,042,090, 5,101,513 and 5,208,918 show additional garments, sometimes in the forms of robes or privacy devices.

It is an object of the present invention to provide a changing robe capable of convenient use in affording privacy to the wearer while facilitating the changing of clothing, such as into and out of swimming gear or beach attire, with provision for efficient storage and retrieval of clothing to be changed. The changing robe is used to advantage by scuba divers, surfers, boaters, campers, swimmers and those engaged in other water sports, as well as in gyms, on cruise ships, in salons and spas and in physical therapy. In addition, the robe is useful to truck drivers, new mothers who are breast-feeding, transsexuals who are excluded from normal changing areas, expectant mothers and wheelchair-bound persons, and can be made in any size from child sizes to the largest adult size.

SUMMARY OF THE INVENTION

A changing robe of the invention has a number of features combined in a single attractive garment which is highly convenient in use and which affords privacy and efficiency in changing clothing in a public or semi-public setting, and in a modified version, provides a conveniently used robe for wheelchair-bound persons. The garment includes a robe body which fits quite loosely on the user, configured to extend around the front and back of the user and of a length sufficient to extend down and cover at least part of the legs of the user. A pair of sleeves preferably are provided, sufficiently short and having sufficiently large sleeve openings to allow the user to conveniently withdraw the arms through the sleeves and into the interior of the robe body. The sleeves may simply comprise reinforced openings in an essentially sleeveless garment. A hood preferably is secured to the top of the changing robe body to engage over the head, leaving the face open. An important feature is a large pocket at the front of the robe body, large enough to contain clothing and with an access opening of the pocket at the inside of the front panel of the robe to facilitate access by the user from the interior of the changing robe.

In a preferred embodiment the hood of the changing robe, where it joins the robe body, forms a very ample neck opening, sufficient to allow the user to look down into the interior of the changing robe while changing clothes.

Another preferred feature of the invention is that the large central pocket on the front pocket of the robe body has an outside front opening with a zipper or other releasable fastener, so that clothing or swim gear, etc. can be stowed in the robe from outside the front of the robe, particularly when the robe is not being worn.

A further feature is that the robe body may have one or two additional outside pockets for storing personal articles. Further inside pockets can be included if desired.

The changing garment of the invention preferably comprises a continuous garment fully encircling the user, rather than being structured so as to permit opening at one or both sides. Although the robe can be made of any flexible material, liquid absorbent terry cloth material (ten to twelve ounce cotton velour) of the robe body and hood helps to dry the hair and skin of the user, such as when the robe is used for changing out of wet swimming gear and back into street clothing. The garment thus serves as a towel and warming enclosure as well as a privacy robe for changing, and the heavy material shields the wearer from wind on wet swim suits, wet suits and scuba suits.

The above and other objects, advantages and features will be apparent from the following description of a preferred embodiment, considered along with the accompanying drawings.

DESCRIPTION OF PREFERRED EMBODIMENTS

Figure 1:
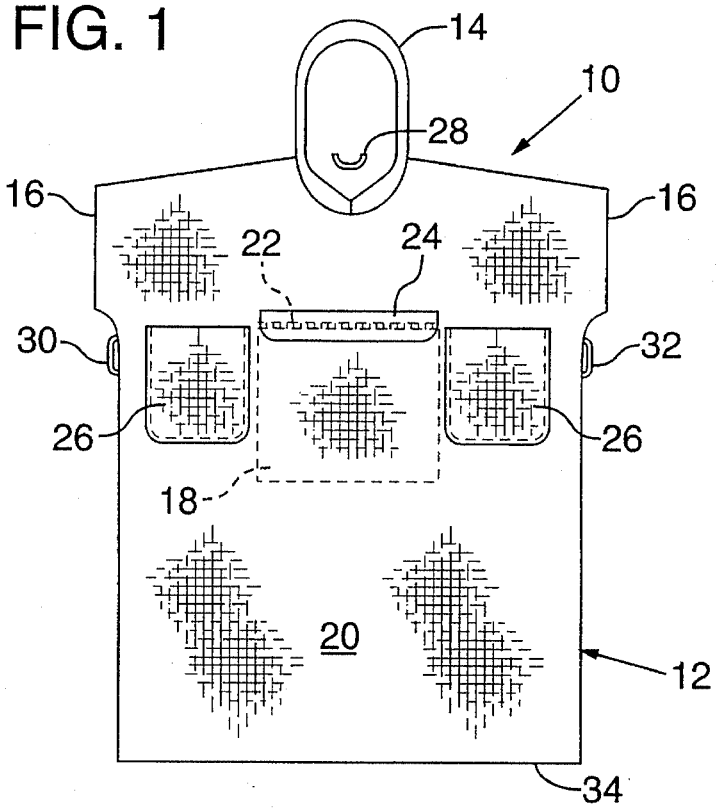
FIG. 1 is a frontal view of a changing garment in accordance with the invention.

FIG. 1 shows, in somewhat schematic frontal view, a garment comprising a changing robe 10, preferably formed of absorbent terry cloth similar to a relatively heavy bath towel (e.g. about 10 to 12-ounce terry cloth), the garment including a body portion 12 and a hood 14 secured to the body portion, as by stitching. The changing robe 10 also includes a pair of short sleeves 16, although the robe may be essentially sleeveless if desired, and the term sleeve should be taken to include a simple reinforced opening in a sleeveless robe. A large central pocket 18 is formed in a front panel 20 of the garment, the pocket being shown in dashed lines in FIG. 1 because of its preferred construction as a layer of fabric secured to the inside of the front panel 20. Although the pocket 18 is formed on the interior of the garment and is accessible from the interior of the garment, it is preferably also accessible from the exterior. A zipper 22, also shown in dashed lines as hidden beneath an optional flap 24, provides access from the front of the garment, so as to enable a user to stow articles into the garment from the outside, when the garment is not being worn or in some circumstances, when the garment is in position on the user's body.

In a preferred embodiment, one or more additional front pockets 26 are also included, preferably accessible from the outside of the garment as shown. The function of these auxiliary pockets can be to store additional personal articles such as keys, wallet, etc., while main articles of clothing can be stowed in the large central pocket 18. One or both of these auxiliary pockets 26 can be eliminated in favor of a larger central pocket 18. Additional inside pockets can be included if desired.

As shown in all of the drawings, the sleeves 16 are sufficiently short and sufficiently large in diameter as to enable the user to retract his or her arms into the interior of the changing robe. This enables changing of clothes to be carried on within the interior of the robe, with access to the large central pocket 18 as shown particularly in FIG. 3. In one preferred embodiment, the sleeves 16 each extend approximately one inch from the robe body and have a flattened length of about 13 to 14 inches, corresponding to a diameter of about 8 to 9 inches.

Figure 3:
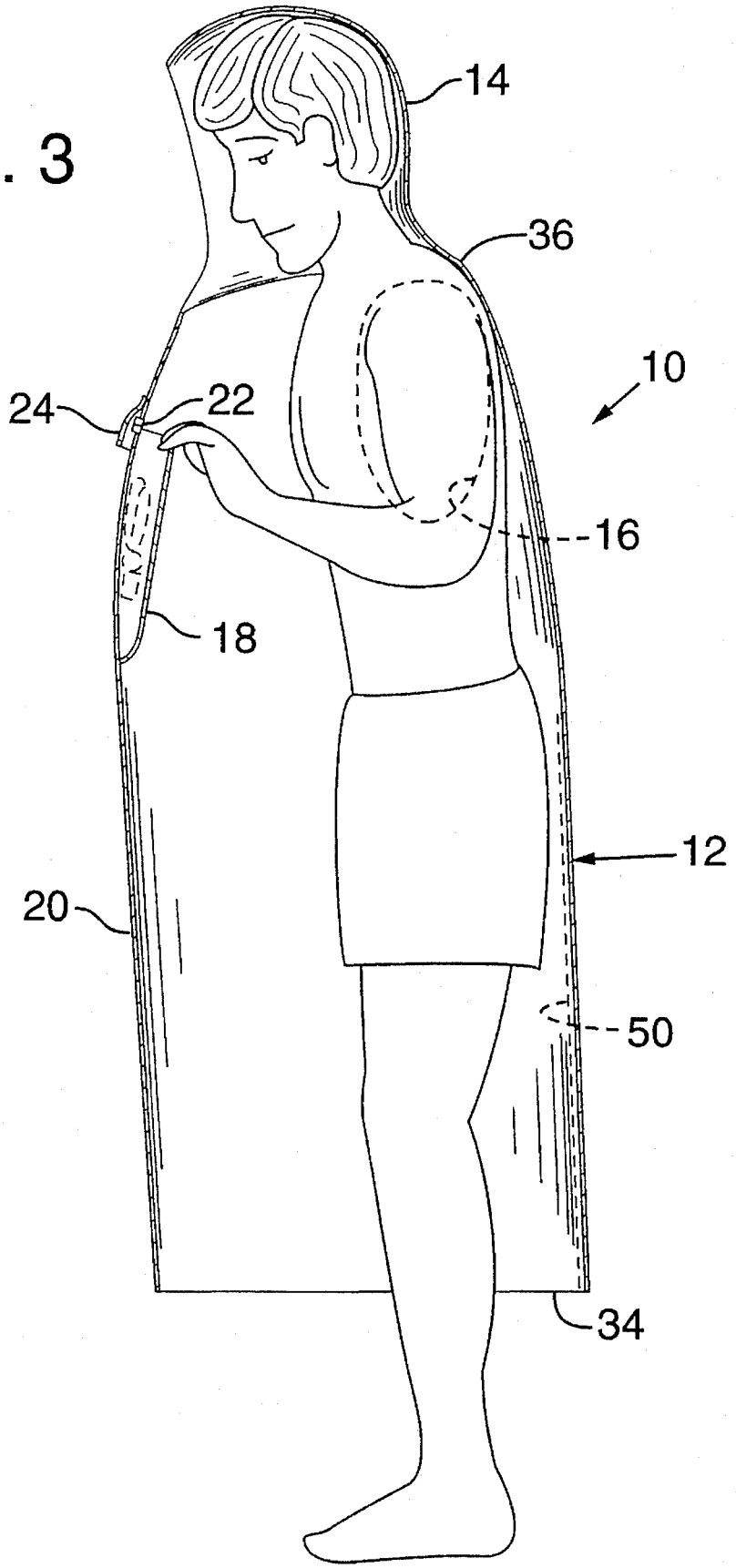
FIG. 3 is a side view, partially in perspective, indicating a user wearing the garment, with the arms within the interior of the garment, in the process of changing clothing in the privacy of the garment's interior.

Another feature in a preferred embodiment of the invention is that the hood 14 is large enough, and meets the robe body in a sufficiently large neck opening, that the user can simply look downwardly within the robe while changing clothes, as indicated in FIG. 3. The robe at the neck is roomy enough to permit this, enabling the user to see what he or she is doing inside. FIG. 3 is a sectional view through the robe, indicating in dashed lines a sleeve 16 opening which is exterior of the user's arm and shoulder in this figure.

As shown in FIG. 1, the inside of the back of the robe body 12, approximately where the robe body meets the hood 14, may have a fabric loop 28, to enable the changing robe to be hung on a hook when not in use. Although the drawing shows this utility loop at the inside back of the garment, accessible through the hood opening, the utility loop could be positioned on the rear surface of the garment if desired.

Figure 2:
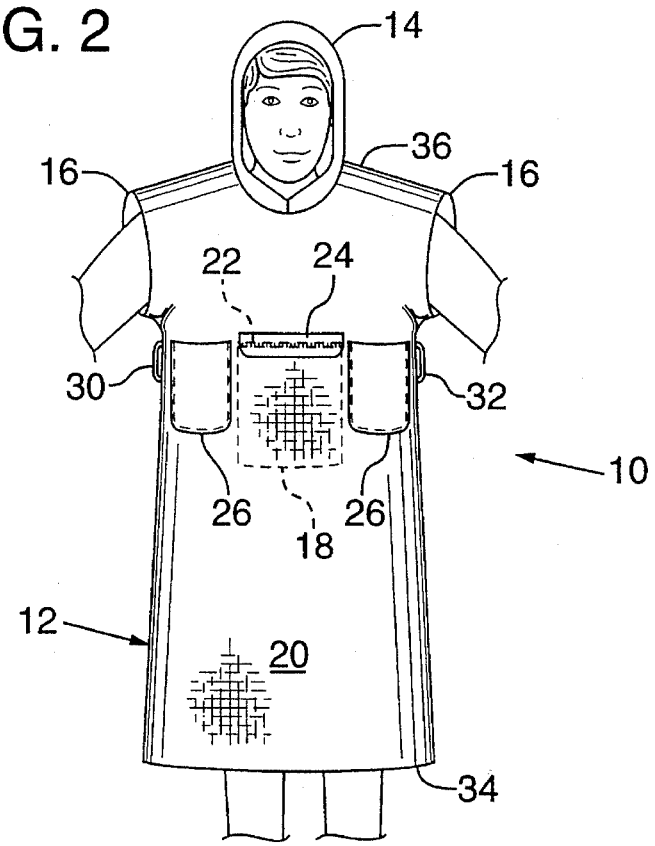
FIG. 2 is a frontal view of the garment as worn by a user, with arms extending through sleeves of the garment.

FIGS. 1 and 2 also show side loops of fabric 30 and 32 which may be included on the garment 10. These can be used for several different purposes, such as for holding a small flashlight via an included clip, or for holding a towel (not shown).

In a preferred embodiment, the changing robe 10 of the invention, for an average medium-size person, is approximately 40 inches wide at the bottom edge 34 when flattened (circumference 80 inches, diameter 25½ inches), and is about 56 inches high from the bottom edge to the shoulder 36, by the hood. This height can range from about 64 inches for extra large, down to about 52 inches or less for a small size. The neck opening may be about 13 to 14 inches when flattened (circumference 26 to 28 inches, diameter about 8 inches to 9 inches).

In a special embodiment of the changing robe of the invention, the robe is adapted particularly for wheelchair-bound persons. For this purpose, the robe has a slit up the back, indicated in a dashed line 50 in FIG. 3 (although the robe 10 in FIG. 3 is illustrated as worn by a standing person). The slit 50, which may extend approximately from the waist down to the lower edge 34, enables the robe to be slipped down over the head of a person seated in a wheelchair. The flaps on either side of the slit 50 can then be tucked in under the buttocks and legs. The thus modified robe is therefore unique in being capable of slipping onto a handicapped, seated person without requiring the person to stand up.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A changing robe for sheltering and affording a user privacy for the changing of clothing while wearing the robe, comprising:

a large robe body which fits loosely on the user, configured to extend around the front and back of the user and of a length sufficient to extend down and cover at least part of the legs of the user, the robe body having a top, a front, a back, interior and an exterior, a pair of sleeves for the arms of the user, the sleeves being sufficiently short and having sufficiently large sleeve openings to allow the user to conveniently withdraw the arms through the sleeves and into the interior of the robe body, and a large pocket at the front of the robe body, sufficiently large to contain clothing, with an access opening of the pocket on a front panel at the interior of the robe body to facilitate access by the user from inside the changing robe.

2. A changing robe according to claim 1, further including a hood secured to the top of the changing robe body for engaging over the head of the user, leaving the face open.

3. A changing robe according to claim 1, wherein the large pocket further includes an access opening at the front of the robe body, accessible from the exterior of the robe body.

4. A changing robe according to claim 3, wherein the access opening at the front of the robe includes a closure zipper.

5. A changing robe according to claim 1, further including at least one additional pocket on the front of the robe body, accessible from outside the front of the robe.

6. A changing robe according to claim 2, wherein the hood of the changing robe is secured to the robe body so as to define a neck opening which is large enough to enable a user to look downwardly into the interior of the changing robe body while changing clothes.

7. A changing robe according to claim 1, further including a slit up the back of the robe body, approximately from waist level down to a bottom edge of the robe body, whereby a wheelchair-bound person can slip on the robe, over the head, without leaving a sitting position.

8. A robe for covering a wearer and in particular for use by a wheelchair-bound person, comprising:

a large robe body which fits loosely on the user, configured to extend around the front and back of the user and of a length sufficient to extend down and cover at least part of the legs of the user, the robe body having a front, a back, an interior and an exterior, a pair of sleeves for the arms of the user, the sleeves being sufficiently short and having sufficiently large sleeve openings to allow the user to conveniently withdraw the arms through the sleeves and into the interior of the robe body, a large pocket at the front of the robe body, sufficiently large to contain clothing, with an access opening of the pocket on a front panel of the robe at the interior of the robe body to facilitate access by the user from inside the changing robe, and a slit up the back of the robe body, approximately from waist level down to a bottom edge of the robe body, whereby a wheelchair-bound person can slip on the robe, over the head, without leaving a sitting position.

9. A changing robe according to claim 1, wherein the large pocket at the front of the robe body is centrally located, in an upper torso region of the user.

10. A robe as in claim 8, wherein the large pocket at the front of the robe body further includes an access opening at the front of the robe body, accessible from the exterior of the robe body.

* * * * *